United States Patent [19]

Gibson et al.

[11] 4,225,364

[45] Sep. 30, 1980

[54] HIGH STRENGTH NICKEL-CHROMIUM-IRON AUSTENITIC ALLOY

[75] Inventors: Robert C. Gibson, Ringwood, N.J.; Michael K. Korenko, Richland, Wash.

[73] Assignee: The United States of America as represented by the United States Department of Energy, Washington, D.C.

[21] Appl. No.: 917,834

[22] Filed: Jun. 22, 1978

[51] Int. Cl.[2] ..... C22C 30/00

[52] U.S. Cl. ..... 148/31; 75/122; 75/134 F

[58] Field of Search ..... 75/122, 134 F, 171; 148/31, 38, 32

[56] References Cited

U.S. PATENT DOCUMENTS

| | | | |
|---|---|---|---|
| 2,994,605 | 8/1961 | Gill et al. | 75/171 |
| 3,705,827 | 12/1972 | Muzyka et al. | 75/171 |

*Primary Examiner*—Arthur J. Steiner

*Attorney, Agent, or Firm*—R. V. Lupo; Richard E. Constant; Daniel C. Abeles

[57] ABSTRACT

A solid solution strengthened Ni-Cr-Fe alloy capable of retaining its strength at high temperatures and consisting essentially of 42 to 48% nickel, 11 to 13% chromium, 2.6 to 3.4% niobium, 0.2 to 1.2% silicon, 0.5 to 1.5% vanadium, 2.6 to 3.4% molybdenum, 0.1 to 0.3% aluminum, 0.1 to 0.3% titanium, 0.02 to 0.05% carbon, 0.002 to 0.015% boron, up to 0.06 zirconium, and the balance iron. After solution annealing at 1038° C. for one hour, the alloy, when heated to a temperature of 650° C., has a 2% yield strength of 307 MPa, an ultimate tensile strength of 513 MPa and a rupture strength of as high as 400 MPa after 100 hours.

4 Claims, No Drawings

HIGH STRENGTH NICKEL-CHROMIUM-IRON AUSTENITIC ALLOY

GOVERNMENT CONTRACT

This invention was conceived during the performance of work under Contract EY-76-C-14-2170 for the Department of Energy.

BACKGROUND OF THE INVENTION

There is, of course, a need for alloys for use at temperatures over 650° C. which must have high tensile, yield and creep-rupture strengths at elevated temperatures. One such alloy is described in U.S. Pat. No. 2,994,605; and while very broad ranges of composition are given in that patent, the only specific examples given have the following range of composition: about 50 to 70% nickel, about 14% chromium, about 2% niobium and/or tantalum, about 2.75 to 3.5% molybdenum and/or tungsten, less than 0.1% titanium, about 1% aluminum, about 0.35% manganese, about 0.5 to 0.75% silicon, about 0.03% carbon and the remainder iron. Such an alloy is described as having an ultimate tensile strength of 115,000 p.s.i. and a 0.2% yield strength of 46,750 p.s.i. at room temperature.

SUMMARY OF THE INVENTION

The present invention resides in the discovery that a high temperature Ni-Cr-Fe alloy having exceptionally good strength characteristics can be derived with lower amounts of nickel and chromium than used in prior art alloys of this type, higher amounts of niobium than the prior art alloys and with the addition of about 1% vanadium. Additionally, the alloy contains up to 0.06% zirconium, 0.1 to 0.3% titanium, 0.1 to 0.3% aluminum, 0.02 to 0.05% carbon, the remainder being essentially all iron.

The above and other objects and features of the invention will become apparent from the following detailed description describing an exemplary embodiment of the invention.

The alloys of the invention have the following broad range and nominal composition:

TABLE I

| | Broad Range weight % | Nominal weight % |
|---|---|---|
| Nickel | 42–48 | 45 |
| Chromium | 11–13 | 12 |
| Niobium | 2.6–3.4 | 3 |
| Silicon | .2–1.2 | 1 |
| Vanadium | .5–1.5 | 1 |
| Molybdenum | 2.6–3.4 | 3 |
| Aluminum | .1–.3 | .2 |
| Titanium | .1–.3 | .2 |
| Carbon | .02–.05 | .03 |
| Boron | .002–.015 | .01 |
| Zirconium | 0–.06 | .03 |
| Iron | Bal | Bal |

The molybdenum and niobium contents are particularly critical. To illustrate the effect of niobium and molybdenum, the alloys identified as D16 and D17 in the following Table II were vacuum-induction melted and cast as 100-pound ingots:

TABLE II

| Alloy | Fe | Ni | Cr | Mo | Nb | V | Si | Zr |
|---|---|---|---|---|---|---|---|---|
| D16 | Bal | 45.0 | 12.0 | 1.5 | 1.0 | 1.0 | 1.0 | 0.03 |

TABLE II-continued

| | | | | | | | | |
|---|---|---|---|---|---|---|---|---|
| D17 | Bal | 45.0 | 12.0 | 3.0 | 3.0 | 1.0 | 1.0 | 0.03 |

| Alloy | Ti | Al | C | B |
|---|---|---|---|---|
| D16 | 0.2 | 0.2 | 0.03 | 0.01 |
| D17 | 0.2 | 0.2 | 0.03 | 0.01 |

Following surface conditioning, the alloys were charged into a furnace, heated to 1093° C. and then soaked for 2 hours prior to hot rolling to 2½ by 2½ inch square billets. The billets were then rolled to ½ inch thick plate which was annealed at 1038° C. and surface-ground. Sheet, 0.03 inch thick, was then produced using cold-reductions of 50% and process anneals at 1038° C.

The mechanical properties of the 0.03 inch sheet were then evaluated for two heat treatments, namely anneal for 1 hour at 1038° C. followed by an air-cool and an anneal for 1 hour at 1038° C. followed by an air-cool plus 30% cold-work. The tensile and stress rupture properties determined for these treatments are given in the following Tables III and IV:

TABLE III

| Alloy | Thermo-mechanical Treatment | Test Temperature (°C.) | 0.2% YS (MPa) | UTS (MPa) | El (MPa) |
|---|---|---|---|---|---|
| D16 | 1038° C./1 hr | RT | 367 | 613 | 28.5 |
| | | 550 | 263 | 483 | 40.0 |
| | | 600 | 238 | 459 | 28.5 |
| | | 650 | 230 | 403 | 27.5 |
| D16 | 1038° C./1 hr + 30% cold-work | RT | —[a] | — | — |
| | | 550 | 649 | 694 | 3.0 |
| | | 600 | 592 | 645 | 2.0 |
| | | 650 | 474 | 730 | 5.5 |
| D17 | 1038° C./1 hr | RT | 384 | 738 | 23.5 |
| | | 550 | 360 | 663 | 19.6 |
| | | 600 | 306 | 581 | 36.5 |
| | | 650 | 307 | 513 | 36.0 |
| D17 | 1038° C./1 hr + 30% cold-work | RT | — | — | — |
| | | 550 | 787 | 860 | 5.0 |
| | | 600 | 678 | 766 | 6.0 |
| | | 650 | 552 | 661 | 9.5 |

[a]No RT testing was done in the cold-worked condition.

TABLE IV

| Alloy | Thermo-mechanical Treatment | Test Temperature (°C.) | Rupture Strength (MPa) 100 hr | Rupture Strength (MPa) Est. 1000 hr |
|---|---|---|---|---|
| D16 | 1038° C./1 hr | 550 | 386 | 331 |
| | | 600 | 272 | 234 |
| | | 650 | 200 | 172 |
| D16 | 1038° C./1 hr | 550 | 483 | 400 |
| | | 600 | 359 | 290 |
| | | 650 | 283 | 234 |
| D17 | 1038° C./1 hr | 550 | 510 | 448 |
| | | 600 | 441 | 414 |
| | | 650 | 290 | 255 |
| D17 | 1038° C./1 hr | 550 | 690 | 648 |
| | | 600 | 538 | 483 |
| | | 650 | 400 | 317 |

Note that Alloy D17 containing 3% niobium and 3% molybdenum has better tensile properties than Alloy D16 containing only 1.5% molybdenum and 1% niobium. Thus, after annealing at 1038° C. for 1 hour, Alloy D17, at a test temperature of 650° C., has a 0.2% yield strength of 307 MPa, an ultimate tensile strength of 513 MPa and a percent elongation of 36. This is contrasted with Alloy D16 which, under the same circumstances, has a 0.2% yield strength of 230 MPa, an ultimate tensile strength of 403 MPa and a percent elongation of 27.5. For that matter, it will be observed that all of the properties of Alloy D17 are superior to those of Alloy D16 under all circumstances. Thirty percent cold-work after solution annealing gives further improved results as shown in Table III.

Table IV shows the stress rupture properties of Alloys D16 and D17. Here, again, the properties of Alloy D17 are superior to those of Alloy D16. For example, the rupture strength of Alloy D16 at 650° C. after 100 hours is in the range of 200 to 283 MPa whereas the rupture strength of Alloy D17 under the same circumstances is in the range of 290 to 400 MPa. It is estimated that the rupture strength of Alloy D17 at 1000 hours will be in the range of 255 to 317 MPa.

Although the invention has been shown in connection with certain specific embodiments, it will be readily apparent to those skilled in the art that various changes in compositional limits can be made to suit requirements without departing from the spirit and scope of the invention.

What is claimed is:

1. A solid solution strengthened alloy consisting essentially of about 42 to 48% nickel, 11 to 13% chromium, 2.6 to 3.4% niobium, 0.2 to 1.2% silicon, 0.5 to 1.5% vanadium, 2.6 to 3.4% molybdenum, 0.1 to 0.3% aluminum, 0.1 to 0.3% titanium, 0.02 to 0.05% carbon, 0.002 to 0.015% boron, up to 0.06% zirconium and the balance iron, the alloy being characterized in having a 2% yield strength of at least 450 MPa and an ultimate tensile strength of at least 500 MPa at a test temperature of 650° C. after solution annealing at 1038° C. for 1 hour plus 30% cold-work.

2. A solid solution strengthened alloy consisting essentially of about 45% nickel, about 12% chromium, about 3% niobium, about 1% silicon, about 1% vanadium, about 3% molybdenum, about 0.2% aluminum, about 0.2% titanium, about 0.03% carbon, about 0.01% boron, about 0.03% zirconium and the balance essentially all iron.

3. The alloy of claim 2 characterized in having a 2% yield strength of about 550 MPa and an ultimate tensile strength of about 660 at a test temperature of 650° C. after solution annealing at 1038° C. for 1 hour plus 30% cold-work.

4. The alloy of claim 2 characterized in having a stress rupture strength of 290 to 400 MPa at 650° C. after solution annealing at 1038° C. for 1 hour.

* * * * *